United States Patent [19]

Migliacci et al.

[11] Patent Number: 4,526,739

[45] Date of Patent: Jul. 2, 1985

[54] PROCESS AND APPARATUS FOR PRECASTING PRESTRESSED-CONCRETE WORKPIECES

[75] Inventors: Antonio Migliacci; Giancarlo Bono, both of Milan; Piero Tognoli, Gorlago, all of Italy

[73] Assignee: Industria Prefabbricati Affini I.P.A. S.p.A., Gorlago, Italy

[21] Appl. No.: 462,900

[22] Filed: Feb. 1, 1983

[30] Foreign Application Priority Data

Feb. 4, 1982 [IT] Italy ..... 19448 A/82

[51] Int. Cl.[3] ..... B28B 23/06

[52] U.S. Cl. ..... 264/228; 249/86; 249/177; 264/297.9; 425/111

[58] Field of Search ..... 249/86, 97, 177; 264/228, 297.9, 274, 333; 425/111, 384, 444

[56] References Cited

U.S. PATENT DOCUMENTS

| | | | |
|---|---|---|---|
| 1,746,696 | 2/1930 | Dows | 249/177 |
| 2,511,761 | 6/1950 | Barber et al. | 425/111 |
| 2,694,847 | 11/1954 | Christiansen | 249/177 |
| 2,695,754 | 11/1954 | Karig | 264/228 |
| 3,471,118 | 10/1969 | Bormann et al. | 249/86 |
| 3,685,783 | 8/1972 | Hilson | 249/86 |
| 3,764,066 | 10/1973 | Kowell | 249/86 |
| 4,051,216 | 9/1977 | Bratchell | 425/111 |
| 4,290,991 | 9/1981 | Thim | 249/86 |

FOREIGN PATENT DOCUMENTS

| | | | |
|---|---|---|---|
| 2462985 | 3/1981 | France | 425/DIG. 44 |

*Primary Examiner*—Jay H. Woo
*Assistant Examiner*—James C. Housel
*Attorney, Agent, or Firm*—Karl F. Ross; Herbert Dubno

[57] ABSTRACT

Workpieces of prestressed concrete, specifically railroad ties, are molded in a form having its bottom covered with several transversely separated templates whose outline corresponds to that of respective ties to be produced; the form is longitudinally traversed by reinforcing rods or cables attached to its ends under tension. Each template is provided with several countersunk nuts to be engaged by retaining bolts which pass through upright screw anchors with downwardly opening throats loosely occupied by internally threaded centering sleeves that come to rest on the associated template. With the form compartmented by removable spacers separating the templates, concrete is poured into each compartment and allowed to harden about the screw anchors rising therein; the retaining bolts are then withdrawn along with the spacers to provide the resulting concrete blocks with a certain mobility whereupon the tensioned reinforcing armatures are released to prestress these blocks and are subsequently cut between them. The blocks can now be individually extracted from the form, with the aid of lifting hooks or draw bars threaded from above into the centering sleeves; after removal of these sleeves from the inverted blocks, mounting bolts are threaded into the screw anchors by way of cleats serving to hold two rails in position on each tie-forming block.

3 Claims, 7 Drawing Figures

PROCESS AND APPARATUS FOR PRECASTING PRESTRESSED-CONCRETE WORKPIECES

FIELD OF THE INVENTION

Our present invention relates to a process and an apparatus for the precasting of workpieces of prestressed concrete, e.g. railroad ties, with precisely positioned inserts.

BACKGROUND OF THE INVENTION

The spacing of the rails of a track of given gauge, supported by transverse ties, is constant along straight track sections but varies from one tie to the next at certain locations such as curves, junctions and switch points. It is therefore customary to use wooden ties for these nonlinear track sections which enable the proper positioning of mounting bolts according to measurements made in situ. thus with the precision necessary at such locations. Though the use of precast workpieces of prestressed concrete for railroad ties is generally desirable, it has been difficult heretofore to provide precast workpieces with inserts such as screw anchors in precisely predetermined positions.

OBJECTS OF THE INVENTION

An important object of our present invention, therefore, is to provide a process for the serial casting of workpieces of prestressed concrete provided with inserts accurately positioned therein, e.g. for use as railroad ties.

A related object is to provide an apparatus for the practice of this process.

SUMMARY OF THE INVENTION

In accordance with our present invention, workpieces containing prefabricated inserts are precast with the aid of a form whose shape corresponds to that of one or more such workpieces and to which reinforcing armatures—rods or cables—are secured under tension above the bottom of the form. One or more prefabricated inserts are attached to the form, preferably at the bottom thereof, whereupon concrete is poured into the form and around the armatures as well as the insert or inserts. After the poured concrete has hardened into a rigid workpiece, each insert is detached from the form and the armatures are disconnected to prestress the workpiece or workpieces which are subsequently extracted from the form.

When the inserts are tubular, e.g. screw anchors engageable by mounting bolts designed to hold down a pair of rails on a tie, each insert is attached to the bottom of the form (prior to the pouring of the concrete) by an upright fastener which passes through the insert and is releasable from above to facilitate a subsequent detachment. Such a fastener is preferably designed as a retaining bolt engaging a threaded aperture in a plate disposed at the bottom of the form; the part containing that aperture, accordingly, serves as a locator which determines the positions of the bolt and thus of the insert relative to the form and therefore of the resulting workpiece. The plate, serving as a template for the workpiece to be cast, can be readily replaced by another template with a threadedly apertured part or equivalent locator in a different position. More particularly, each template may be provided with a number of such locators whose spacing from one another and from the walls of the form determines the positioning of respective inserts in the workpiece.

The form, pursuant to a more particular feature of our invention, may be provided with removable spacers dividing its interior into a plurality of compartments for the simultaneous casting of several workpieces traversed by the same reinforcing armatures which are straddled by the spacers; both the spacers and the fasteners are to be removed from the form before the tensioned armatures are released after the setting of the concrete, in order to provide the workpieces with a certain degree of mobility which allows them to follow the foreshortening of parts of the armatures not encased by concrete. In order to separate the finished workpieces from one another, the armatures can be severed in the clearances left vacant by the extracted spacers.

BRIEF DESCRIPTION OF THE DRAWING

The above and other features of our invention will now be described in detail with reference to the accompanying drawing in which.

SPECIFIC DESCRIPTION

Figure 1:
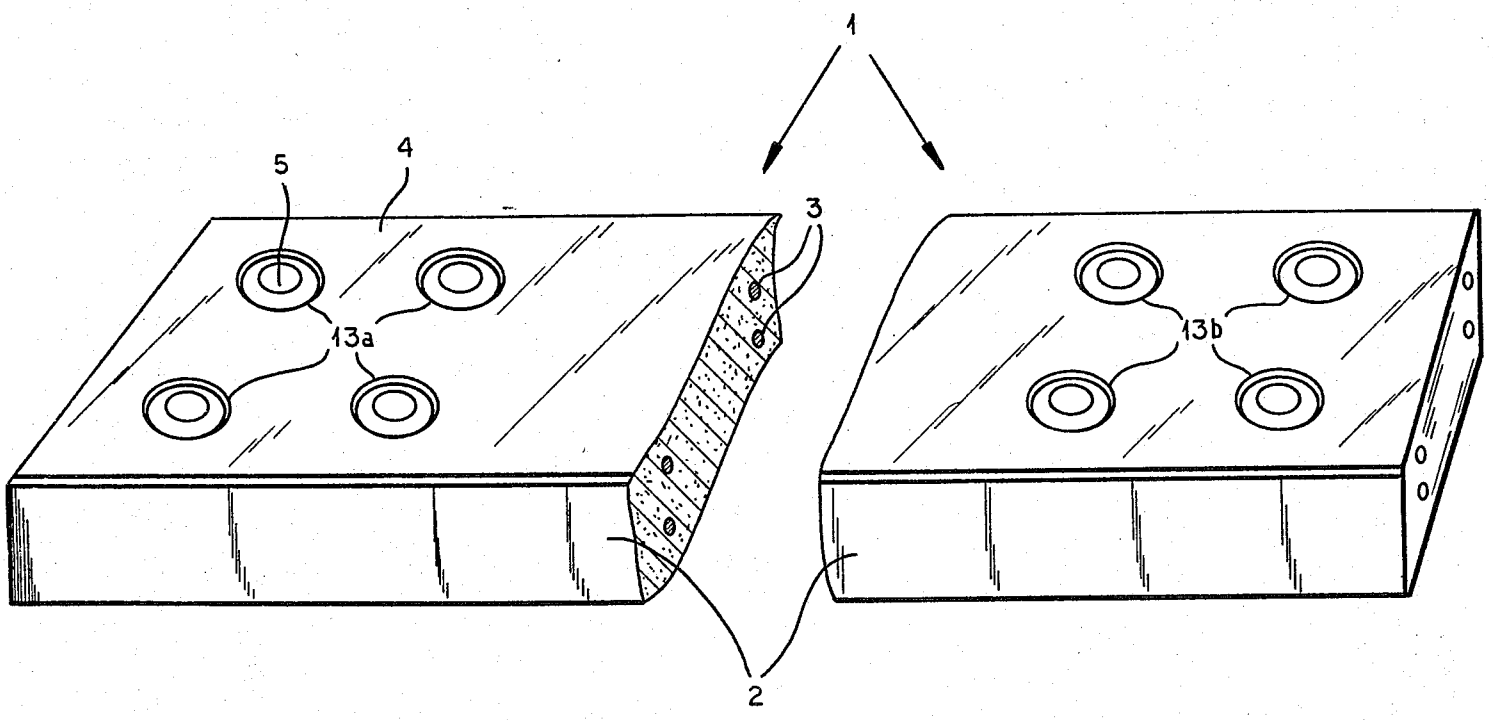
FIG. 1 is a perspective view of a block of prestressed concrete—specifically a railroad tie—provided with a number of embedded inserts in accordance with our invention.
Figure 2:
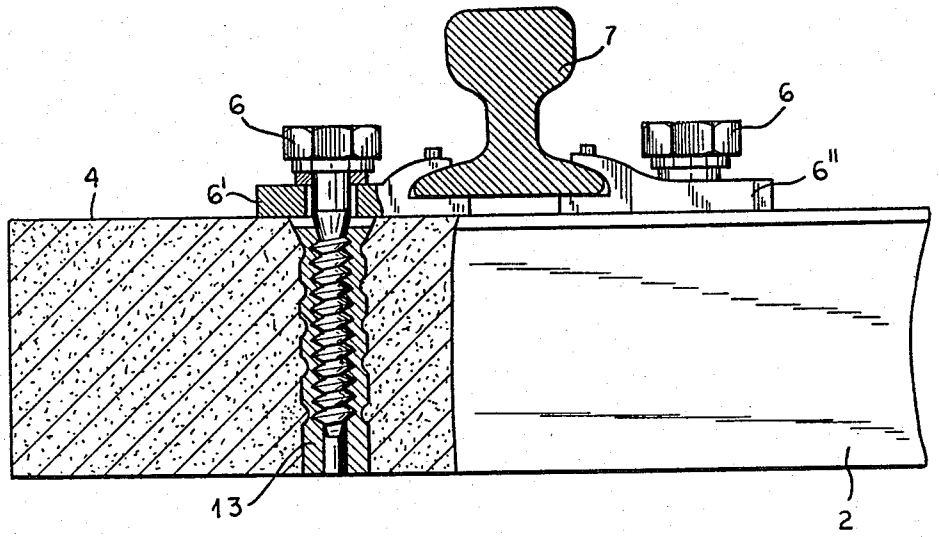
FIG. 2 is a fragmentary side view, partly in section, of the railroad tie shown in FIG. 1.
Figure 5:
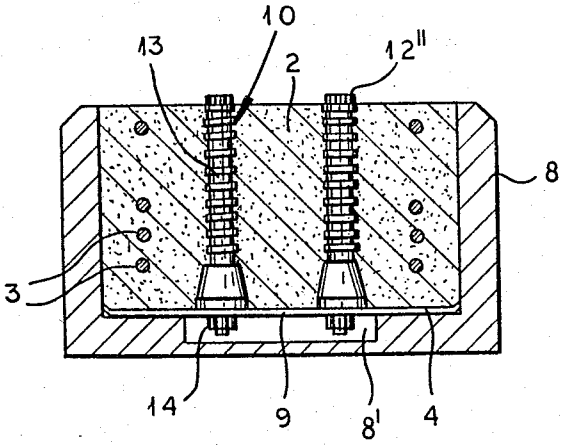
FIG. 5 is a cross-sectional view taken on the line V—V of FIG. 4.
Figure 6:
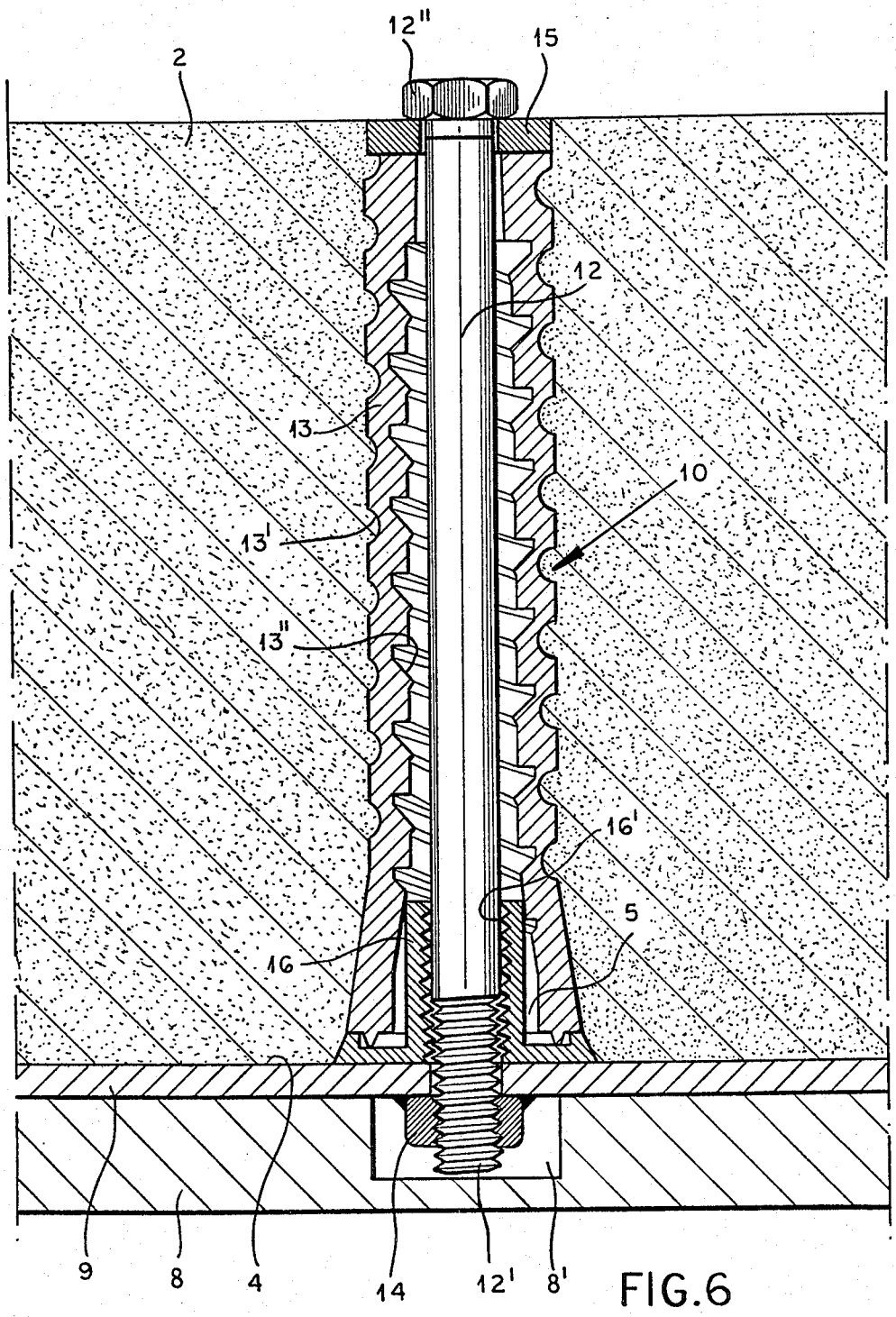
FIG. 6 is an enlarged cross-sectional detail view of an assembly including a screw anchor shown in FIGS. 3–5.
Figure 7:
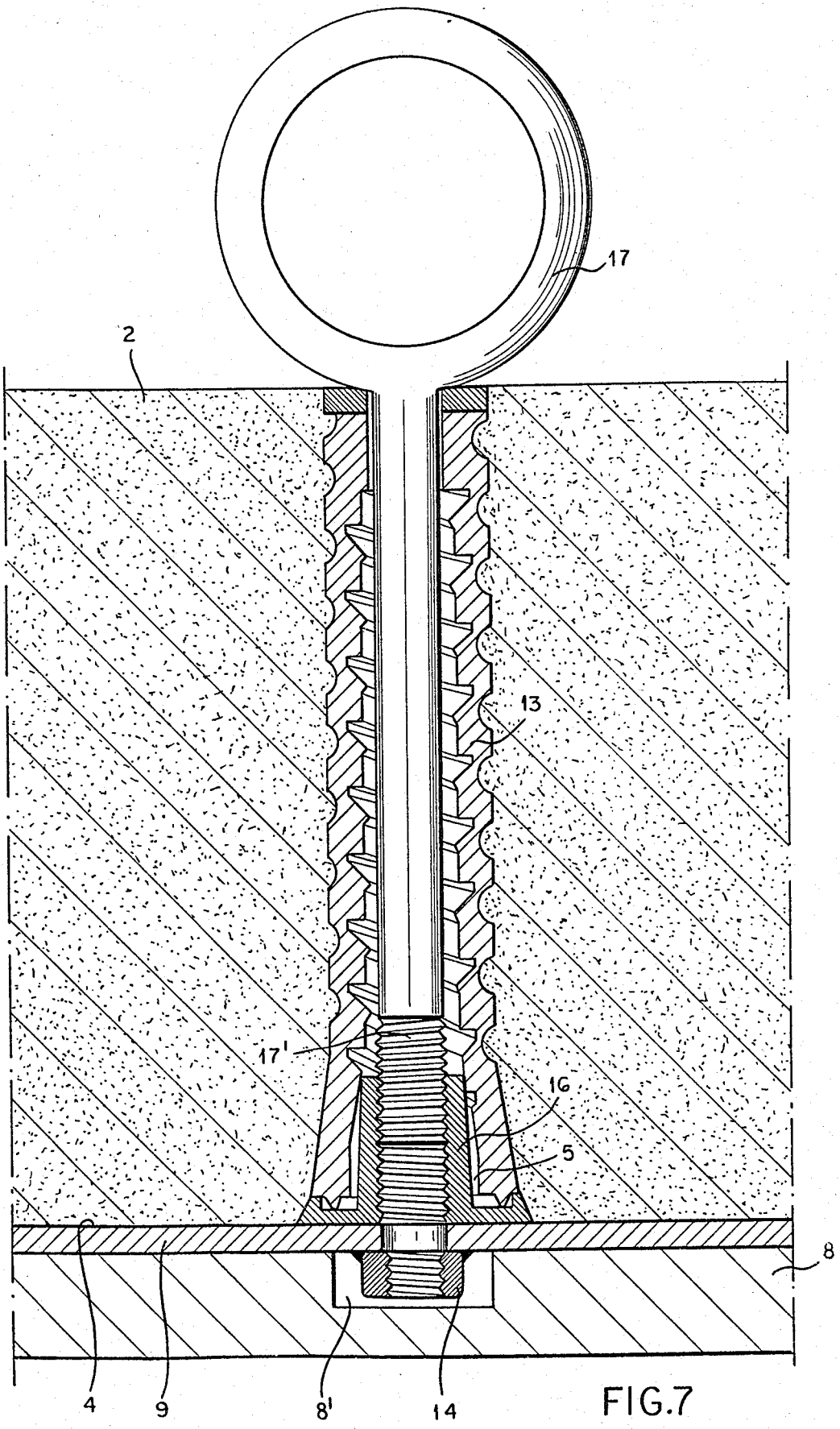
FIG. 7 is a view similar to FIG. 6, showing the screw anchor after removal of a retaining bolt and introduction of a draw bar facilitating the extraction of a cast workpiece.

In FIG. 1 we have shown a railroad tie 1 which comprises a prismatic block 2 of concrete prestressed by a number of reinforcing rods or armatures 3 as is well known per se. The block 2 has embedded therein two sets of screw anchors 13*a*, 13*b*, generally designated 13 in FIGS. 2, 6 and 7, with throats 5 opening onto the upper block surface 4. Each screw anchor 13, as illustrated in FIG. 2, is threadedly engageable by a mounting bolt 6 which traverses one of two cleats 6', 6'' serving to engage a rail 7 when the railroad tie formed by this block is emplaced on a track. Thus, the two pairs of screw anchors shown at 13*a* in FIG. 1 receive the bolts respectively holding down the cleats 6' and 6'' of FIG. 1 for one rail 7 while a similar array of bolts and cleats secures another rail to the tie 1 by engagement with the other set of screw anchors 13*b*.

Figure 3:
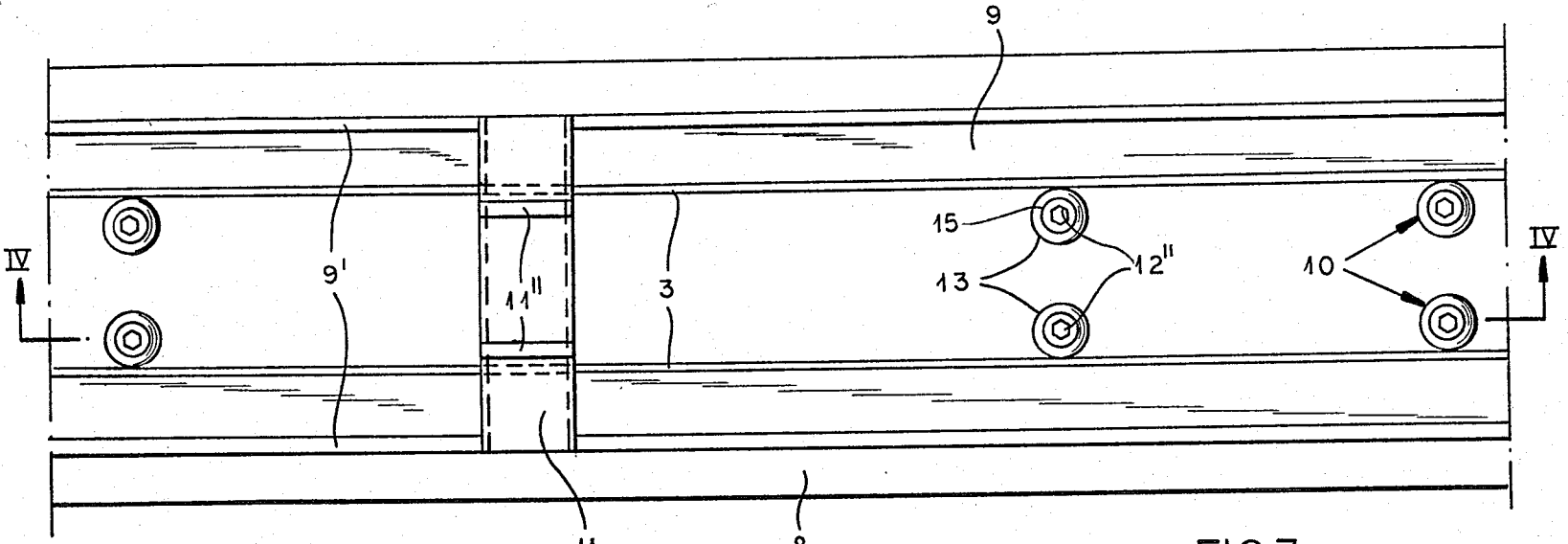
FIG. 3 is a partial top view of a form for the molding of prestressed railroad ties.
Figure 4:
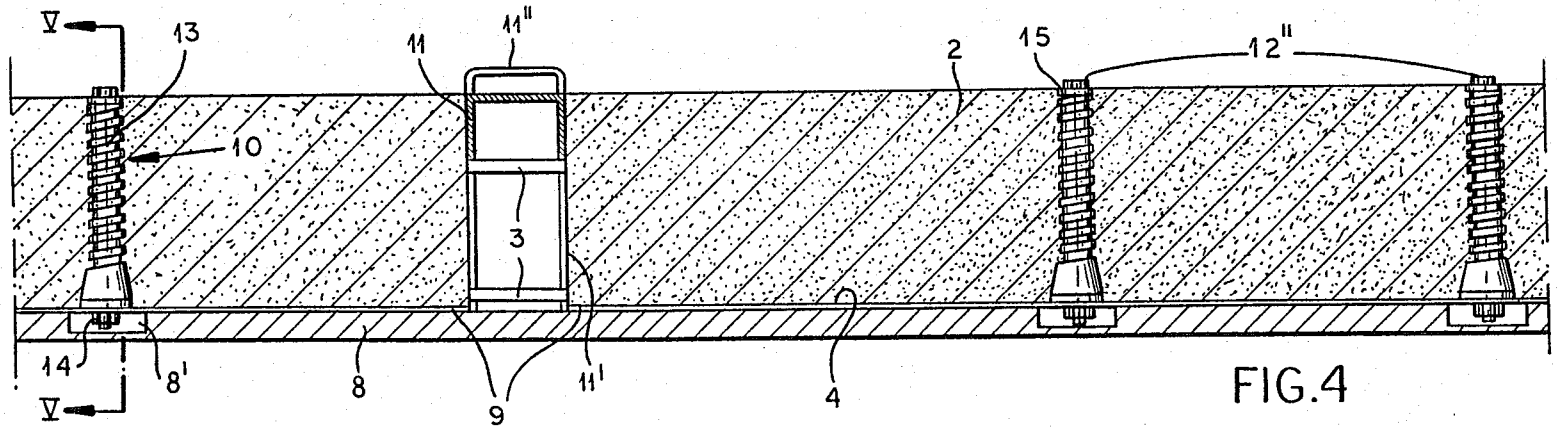
FIG. 4 is a longitudinal sectional view of the form filled with concrete, taken on the line IV—IV of FIG. 3.

FIGS. 3–7 show part of a form 8 for the molding of several blocks 2, such as that illustrated in FIGS. 1 and 2, each with a group of screw anchors 13 inserted in the concrete. Before the molding operation, with the form 8 empty as seen in FIG. 3, rectangular templates 9 are placed on the bottom of the form and are longitudinally separated from one another by removable spacers 11. Each template 9 is a flat metal plate with upstanding longitudinal beads 9' defining beveled major edges of the block to be cast. Armatures 3 extend longitudinally within the form above its bottom and pass through slots 11' of spacers 11 which can therefore be extracted from the form with the aid of handles 11''. These spacers and the nonillustrated end walls of the form define, accordingly, a plurality of prismatic compartments in which the several blocks are to be molded. The armatures 3 are anchored under tensile stress to the end walls by the usual releasable connectors such as threaded terminals engaged by tensioning nuts.

Within each compartment, in accordance with our invention, several assemblies 10 are initially secured to the corresponding template 9 at the locations provided for the screw anchors 13*a* and 13*b* of FIG. 1. At each such location the template 9 is rigid with a nut 14 countersunk into a recess 8' of the form. Each assembly 10 includes a screw anchor 13 whose bore is traversed with clearance by a smooth stemmed retaining bolt 12 threaded at its lower end 12' into the associated nut 14; bolt 12 has a head 12'' bearing upon the top of the screw anchor 13 through the intermediary of a washer 15. The screw anchor has external recesses 13', here shown as a helical groove, designed to maintain it in positive contact with the body of concrete to be poured therearound. The inner wall of the screw anchor has a female thread 13'' designed to mate with the male thread of a mounting bolt 6 (FIG. 2) to be subsequently connected therewith. A further element of assembly 10 is a centering sleeve 16, see FIGS. 6 and 7, which has an internal thread 16' of a diameter slightly larger than that of bolt 12 so as not to be matingly engaged thereby; this sleeve fits closely but detachably into the diverging throat 5 of the screw anchor 13 which in the molding position lies at the lower end thereof. With this arrangement each screw anchor 13 rises vertically from the template 9 in precise coaxial alignment with the associated nut 14 serving as a locator therefor.

After concrete has been poured into each compartment of form 8 and has hardened around the inserts 13, the bolts 12 are unscrewed from their nuts 14 and withdrawn from the inserts together with their washers 15; the spacers 11 are also removed so as to give the hardened blocks 2 a certain longitudinal mobility relative to form 8 and templates 9 upon which they rest with their working surfaces 4. Next, the armatures 3 are disconnected from the end walls of the form and, tending to contract, prestress the blocks 2 as is well known in the art; naturally, any movement then undergone by the blocks does not affect the relative position of the screw anchors 13 embedded therein. The armatures can now be severed between the blocks by suitable cutters introduced into the clearances left vacant by the extracted spacers 11. Thereafter lifting hooks or draw bars 17 are introduced from above into the inserts 13 and with their treaded lower ends 17' are screwed into the centering sleeves 16 to facilitate the removal of each block 2 from the form 8. When this is done, the lifting implements 17 are unscrewed and removed from the inserts together with the sleeves 16 whereby these inserts, with their throats 5 facing upward, are available for use as railroad ties in the manner described with reference to FIG. 2.

We claim:

1. A process for precasting workpieces of prestressed concrete containing prefabricated internally threaded screw anchors, comprising the steps of:

(a) providing a form of a shape corresponding to that of at least one workpiece with a horizontal nut fixedly secured to the bottom of said form;

(b) securing reinforcing armatures under tension to said form above said bottom;

(c) removably attaching a prefabricated screw anchor to said form by threading a headed bolt from above through the screw anchor into engagement with said nut, said bolt passing with clearance through the screw anchor without engaging the internal thread thereof;

(d) pouring concrete into the form around said armatures and said screw anchor;

(e) allowing the poured concrete to harden into a rigid workpiece;

(f) detaching said bolt from said nut;

(g) disconnecting said armatures from said form to prestress the workpiece; and (h) extracting the workpiece from said form, said bolt being held centered in said insert by a sleeve resting on said bottom, the extraction of the workpiece in step (h) being accomplished with the air of a lifting implement passed through said screw anchor into engagement with said sleeve.

2. An apparatus for precasting workpieces of prestressed concrete containing prefabricated internally threaded screw anchors, comprising:

a form of a shape corresponding to that of at least one workpiece, said form having a bottom rigid with a countersunk nut;

reinforcing armatures extending across said form above the bottom thereof while being releasably secured to opposite sides therof;

a headed retaining bolt with a threaded end insertable from above through a screw anchor into engagement with said nut; and a centering sleeve resting on said bottom and surrounding the lower end of said bolt in the nut-engaging position thereof for maintaining an all-around clearance between said bolt and the screw anchor tranversed thereby, said centering sleeve being internally threaded for engagement by a lifting implement serving to extract the workpiece from said form.

3. An apparatus for precasting workpieces of prestressed concrete each containing a plurality of prefabricated internally threaded screw anchors in a predetermined relative position, comprising:

a form of a shape corresponding to that of at least one workpiece;

reinforcing armatures extending across said form above the bottom thereof while being releasably secured to opposite sides thereof;

a template disposed on the bottom of said form and provided with a plurality of threaded apertures;

a plurality of headed retaining bolts with threaded ends insertable from above through respective screw anchors into engagement with said apertures, the heads of said retaining bolts being accessible after a filling of the form with concrete for disengagement from said apertures to detach said screw anchors from said template prior to a disconnection of said armatures from said form; and a plurality of centering sleeves resting on said template and surrounding the lower ends of said bolts in the aperture-engaging positions thereof for maintaining an all-around clearance between said bolts and the screw anchors traversed thereby, said centering sleeves being internally threaded for engagement by lifting implements serving to extract the workpiece from said form.

* * * * *